US007249543B1

(12) United States Patent
Pomerantz

(10) Patent No.: US 7,249,543 B1
(45) Date of Patent: Jul. 31, 2007

(54) 4-IN-1 POCKET SCREWDRIVER

(75) Inventor: Joe Pomerantz, Moorpark, CA (US)

(73) Assignee: Advantek Marketing, Inc., Moorpark, CA (US)

( * ) Notice: Subject to any disclaimer, the term of this patent is extended or adjusted under 35 U.S.C. 154(b) by 0 days.

(21) Appl. No.: 11/403,645

(22) Filed: Apr. 13, 2006

(51) Int. Cl.
*B25B 23/00* (2006.01)
*B25B 15/00* (2006.01)
*B25B 23/16* (2006.01)

(52) U.S. Cl. ..... 81/439; 7/165

(58) Field of Classification Search ..... 81/439, 81/124.3, 124.7, 125.1, 177.4; 7/165
See application file for complete search history.

(56) References Cited

U.S. PATENT DOCUMENTS

| | | | | | |
|---|---|---|---|---|---|
| D26,157 | S | * | 10/1896 | Lee | D8/85 |
| 851,351 | A | * | 4/1907 | Hanley | 7/138 |
| 2,022,775 | A | * | 12/1935 | Holland-Letz | 81/439 |
| D167,058 | S | * | 6/1952 | Rhodes | D8/85 |
| D180,643 | S | * | 7/1957 | Fitch | D8/85 |
| D197,915 | S | * | 4/1964 | Ayars | D8/26 |
| 4,467,677 | A | * | 8/1984 | Grifford | 81/439 |
| 4,926,721 | A | * | 5/1990 | Hsiao | 81/177.4 |
| 5,086,674 | A | * | 2/1992 | Her | 81/124.4 |
| D328,019 | S | * | 7/1992 | Beizer | D8/82 |
| D344,664 | S | * | 3/1994 | Malkinson | D8/85 |
| 5,711,194 | A | * | 1/1998 | Anderson et al. | 81/440 |
| 5,743,737 | A | * | 4/1998 | Hawn et al. | 433/141 |
| 6,062,111 | A | * | 5/2000 | Wershe | 81/177.4 |
| 6,308,599 | B1 | * | 10/2001 | Fu-Hui | 81/490 |
| 6,739,224 | B1 | * | 5/2004 | Wershe | 81/437 |
| 7,107,885 | B2 | * | 9/2006 | Chen | 81/490 |

* cited by examiner

*Primary Examiner*—David B. Thomas
(74) *Attorney, Agent, or Firm*—MacPherson Kwok Chen & Heid LLP; Tom Chen

(57) ABSTRACT

A pocket screwdriver has an oval body portion having a hole through the width of the body portion for holding a first double-ended screwdriver bit and a shaft portion having a hole for holding a second double-ended screwdriver bit. The bits can be interchanged by removing the bit from the shaft and using it to push out the bit from the body portion. The wide body portion enables the user to more easily use the screwdriver, while the hole in the body portion allows an additional screwdriver bit to be used.

15 Claims, 1 Drawing Sheet

4-IN-1 POCKET SCREWDRIVER

BACKGROUND

1. Field of Invention

The present invention relates generally to tools and in particular to pocket tools.

2. Related Art

Pocket tools are typically designed to be carried by individuals without the need for tool boxes or carrying cases. This enables the individual to have easy access to the tool whenever a use arises. One type of conventional pocket tool is a pocket screwdriver, which is shaped like a pen so that it can be carried in or clipped onto a pocket. The pocket screwdriver has a removable screwdriver tip at one end and a handle for turning the screwdriver on the other end. The screwdriver tip has one type of tip on one end and another type of type on the other end. For example, the screwdriver tip may have a blade tip on one end and a Philips tip on the other, or the screwdriver tip may have the same type of tip, but different sizes on the two ends. This allows the pocket screwdriver to function essentially as two different screwdrivers.

However, such a pen-type pocket screwdriver has disadvantages. One, the screwdriver is limited to two types of screwdriver types. While this is advantageous over a single screwdriver type, a larger number of screwdriver tips would be even better. Two, the handle of the pen-type pocket screwdriver, which typically has a small diameter, does not allow the user to apply significant torque. Three, the length of the pen-type screwdriver can make carrying the screwdriver in a pants pocket uncomfortable or awkward.

Therefore, there is a need for a pocket screwdriver that overcomes the disadvantages of conventional pen-type pocket screwdrivers discussed above.

SUMMARY

According to one aspect of the invention, a pocket screwdriver has a wide handle capable of holding a double-ended screwdriver bit width-wise along and through the handle. The pocket screwdriver also has a shaft for holding a second double-ended screwdriver bit for use. A detachable cap can be placed over the end of the screwdriver tip in the shaft to cover the tip when not in use.

In one embodiment, the handle has a through hole along the width, which can snuggly hold a double-ended screwdriver bit. The handle can be an oval shape, square or rectangular shape, or any other suitable shape that has a width approximately the same or wider than the length of the screwdriver bit. The shaft also has a hole, which holds a second double-ended screwdriver bit. The hole in the shaft extends toward, but does not reach the through hole in the handle. The hole in the shaft also is non-circular, i.e., it has edges, such as an octagonal, square, or hexagonal shape. The edges allow the screwdriver tip to be used without the bit rotating within the hole. When a different tip is needed, the bits can be swapped out by first removing the first bit from the shaft and using the first bit to push out the second bit in the handle. The first bit can then be stored in the handle and the second bit inserted into the shaft for use.

Such a pocket screwdriver enables four different screwdriver tips to be used in a single tool, is compact for easy carrying, and allows the user to apply higher torque due to the wide handle of the screwdriver.

These and other features and advantages of the present invention will be more readily apparent from the detailed description of the preferred embodiments set forth below taken in conjunction with the accompanying drawings.

BRIEF DESCRIPTION OF THE DRAWINGS

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
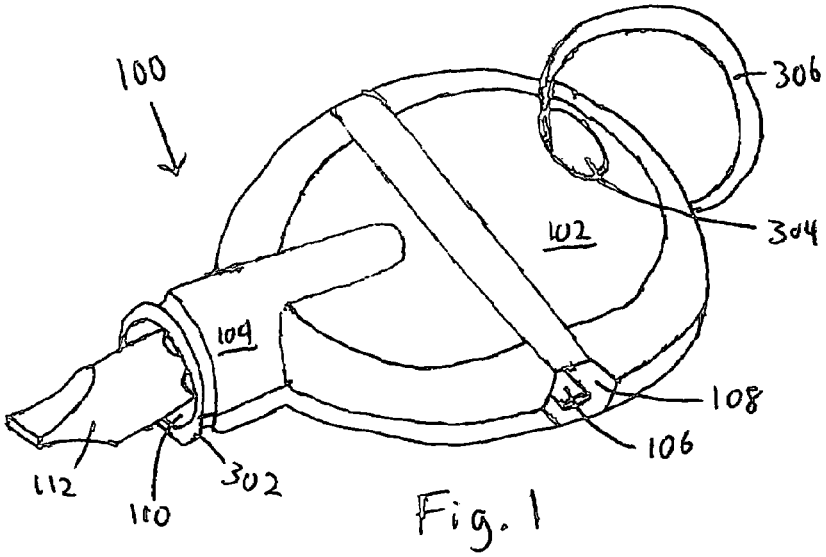
FIG. 1 is a perspective view of a pocket screwdriver according to one embodiment.
Figure 2:
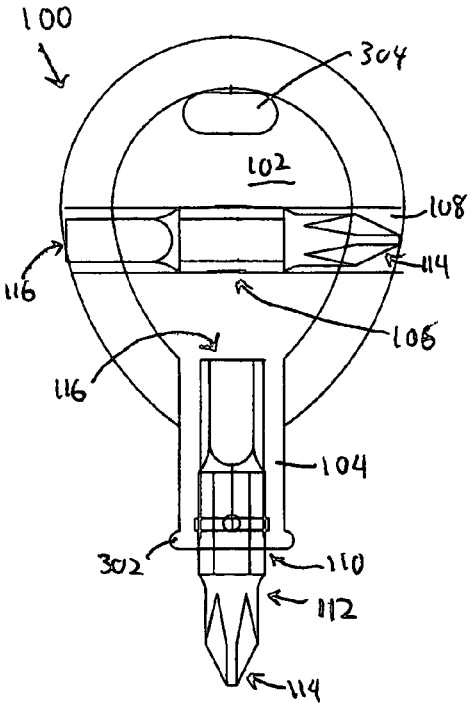
FIG. 2 is a front view of the pocket screwdriver of FIG. 1.

FIGS. 1 and 2 are perspective and front views, respectively, of a pocket screwdriver 100 according to one embodiment of the present invention. Pocket screwdriver 100 includes a handle portion 102 and an integrated shaft portion 104. In this embodiment, handle and shaft are a unitary body, such as formed by injection molding. In other embodiments, the handle and shaft may be separately formed and then assembled together. Handle portion 102 has a body sufficiently wide to hold a first screwdriver bit 106. As shown in this embodiment, the width is approximately the same or wider than the length of the screwdriver bit, which prevents the tip of the screwdriver bit from protruding to enable easier carrying and use. The relatively wide handle portion also enables the user to more easily use the screwdriver because of the ability to apply higher torque.

A through-hole 108 in handle portion 102 holds first screwdriver bit 106 in place when not in use. Through-hole 108 extends from one side of handle portion 102 to the other side and has a hexagonal shape in this embodiment. Other shapes may also be suitable, such as any polygonal shape or even a circular shape. Note that through-hole 108 only has openings at the sides of handle portion 102 and not at the top or bottom. The size of through-hole is the same or smaller than the thickest part of the screwdriver bit so that the screwdriver bit is held securely in place and does not easily fall out of handle portion 102.

Shaft portion 104 also has a hole 110, but not a through-hole, to hold a second screwdriver bit 112. Hole 110 extends toward, but does not reach through-hole 108. In one embodiment, hole 110 is close to through-hole 108, resulting in a compact sized pocket screwdriver. Hole 110 is a polygonal shape, such as hexagonal, so that second screwdriver bit 112 is held securely when the screwdriver is in use. In other words, the non-circular shape of the hole corresponds to the shape of the screwdriver bit to prevent the screwdriver bit from rotating within the hole when in use.

First and second screwdriver bits 106 and 112 are conventional double-ended bits. Each bit has a first end 114 having one type of bit and a second end 116 having a second type of bit. Types of bits can be any suitable bit, such as Philips, blade, Allen, etc. The types of bits can also be the same, but of different size. As discussed above, a middle portion separating the first and second ends has a polygonal shape and has the same or larger width than the widest bit. This allows the bits to be held in through-hole 108 in the handle and in hole 110 in the shaft.

When it is desired to use first screwdriver bit 106, the user simply pulls out second screwdriver bit 112 from shaft portion 104 and uses either end of second bit 112 to push out first bit 106 from handle portion 102. Second bit 112 can then be inserted into handle portion 102, while first bit 106 can be inserted into shaft portion 104 for use.

Figure 3:
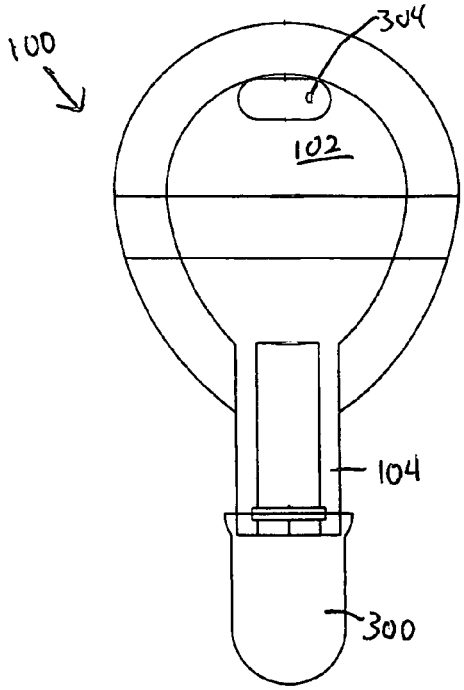
FIG. 3 is a front view of the pocket screwdriver of FIG. 1 with a cap according to one embodiment of the present invention.

FIG. 3 shows pocket screwdriver 100 with a cap 300. Cap 300 can snap onto a groove or lip 302 on shaft portion 104 (see FIGS. 1 and 2) to secure cap 300 to shaft portion 104. Note that any mechanism that secures cap 300 to shaft portion 104 is suitable. Cap 300 covers the exposed tip of the screwdriver bit. This prevents the tip from causing damage or inconvenience when not in use.

In this embodiment, pocket screwdriver 100 also has a key ring hole 304 so that a key ring 306 can be used (see FIG. 1). Thus, the pocket screwdriver can be attached to a key ring and keys. Other carrying mechanisms can also be attached through hole 304, such as, but not limited to, chains and carabiners (or carabineers).

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as fall within the true spirit and scope of this invention.

What is claimed is:

1. A pocket tool, comprising:

a flattened oval or circular-shaped handle portion having a single through-hole through the width of the handle portion, wherein the through-hole is configured to hold a first double-ended screwdriver bit completely within the through-hole; and a non-movable shaft portion having a shaft hole along the length of the shaft portion, wherein the shaft hole is configured to hold a second double-ended screwdriver bit and wherein the second double-ended screwdriver bit extends into the handle portion and is perpendicular to and on the same plane as the through-hole.

2. The pocket tool of claim 1, further comprising a cap configured to fit over the end of the shaft portion and cover an end of the second double-ended screwdriver bit.

3. The pocket tool of claim 1, wherein the handle portion has a hole through which a key ring, chain, or carabiner can be attached.

4. The pocket tool of claim 1, wherein the through-hole is a polygonal shape.

5. The pocket tool of claim 4, wherein the through-hole is a hexagonal shape.

6. The pocket tool of claim 1, wherein the shaft hole is a polygonal shape.

7. The pocket tool of claim 6, wherein the shaft hole is a hexagonal shape.

8. The pocket tool of claim 1, wherein the handle portion and the shaft portion are a unitary body.

9. The pocket tool of claim 1, wherein the first and second screwdriver bits are approximately the same length.

10. A pocket screwdriver, comprising:

a flat oval or circular-shaped handle portion having a single first hole through the width of the handle portion;

a first double-ended tool configured to fit through and be held by and completely within the first hole;

a non-movable shaft portion having a second hole extending toward the first hole; and a second double-ended tool configured to fit into and be secured by the second hole, wherein the second double-ended screwdriver bit extends into the handle portion and is perpendicular to and on the same plane as the first hole.

11. The pocket screwdriver of claim 10, further comprising a cap configured to fit onto the shaft portion and cover an end of the second double-ended tool.

12. The pocket screwdriver of claim 10, wherein the first and second double-ended tool are screwdriver bits.

13. The pocket screwdriver of claim 10, wherein the handle portion has a hole through which a key ring, chain, or carabiner can be attached.

14. The pocket screwdriver of claim 10, wherein the first and second holes are a polygonal shape.

15. The pocket screwdriver of claim 10, wherein the handle portion and the shaft portion are a unitary body.

* * * * *